US008613212B2

(12) United States Patent
Deplano et al.

(10) Patent No.: US 8,613,212 B2
(45) Date of Patent: Dec. 24, 2013

(54) MULTIFUNCTIONAL EXTRUDING PRESS WITH MULTIPLE EQUIPMENT AND EXTRUSION METHOD THEREOF

(75) Inventors: Stefano Deplano, Genoa (IT); Umberto Magnoli, Milan (IT); Maurizio Borgonovo, Legnano (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 15 days.

(21) Appl. No.: 12/998,537

(22) PCT Filed: Nov. 3, 2009

(86) PCT No.: PCT/EP2009/064534

§ 371 (c)(1),
(2), (4) Date: Apr. 29, 2011

(87) PCT Pub. No.: WO2010/060753

PCT Pub. Date: Jun. 3, 2010

(65) Prior Publication Data

US 2011/0214469 A1 Sep. 8, 2011

(30) Foreign Application Priority Data

Nov. 3, 2008 (IT) ..... MI08A1932

(51) Int. Cl.
*B21C 27/00* (2006.01)
*B21C 33/00* (2006.01)

(52) U.S. Cl.
USPC ..... 72/272; 72/270

(58) Field of Classification Search
USPC ..... 72/270, 272, 253.1, 273.5, 263, 265, 72/266, 273
See application file for complete search history.

(56) References Cited

U.S. PATENT DOCUMENTS

| | | | | |
|---|---|---|---|---|
| 3,182,478 | A | 5/1965 | Asari | |
| 3,182,479 | A * | 5/1965 | Rosenthal | 72/272 |
| 4,424,696 | A * | 1/1984 | Asari et al. | 72/272 |
| 4,895,506 | A * | 1/1990 | Nonini et al. | 72/273.5 |

FOREIGN PATENT DOCUMENTS

| | | |
|---|---|---|
| EP | 0 318 631 | 6/1989 |
| GB | 804220 | 11/1958 |
| JP | 03-169424 | * 7/1991 |

* cited by examiner

*Primary Examiner* — Dana Ross
*Assistant Examiner* — Mohammad I Yusuf
(74) *Attorney, Agent, or Firm* — Stetina Brunda Garred & Brucker

(57) ABSTRACT

An extruding press comprising: a die platen element (25) with an extrusion matrix (24) from which an extruded product comes out; a main cylinder (21); longitudinal columns (29) connecting the die platen element (25) to the main cylinder (21); a multiple equipment provided with at least two containers (23', 23") for housing the billets, and comprising an external, longitudinally moving, cross element and a transversally moving ram inside said cross element which comprises the containers; means for longitudinally moving the cross element and means for transversally moving the internal ram to make one of the containers (23', 23") face the extrusion matrix (24) and make one or more of the other containers be in front of the billet introducing means (30) at the same time as said extrusion of the billet.

6 Claims, 10 Drawing Sheets

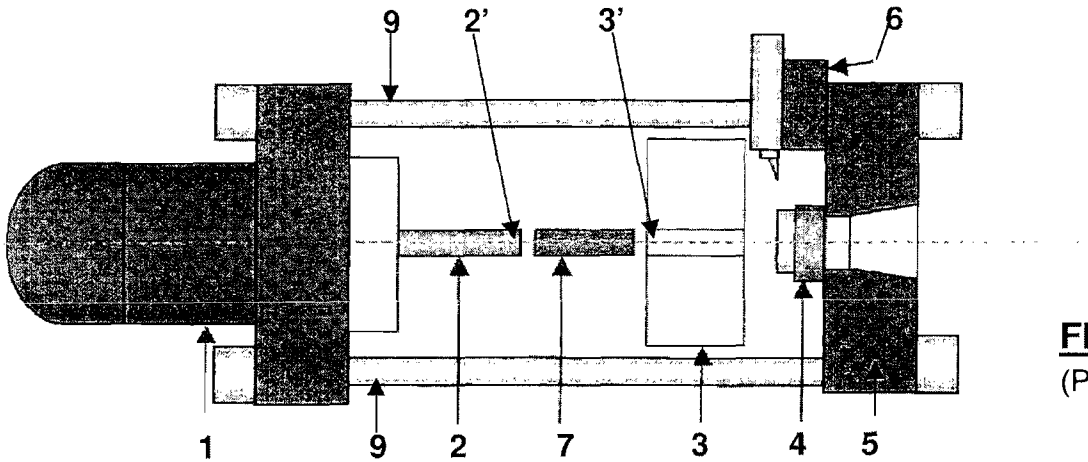
FIG. 1.1
(Prior Art)
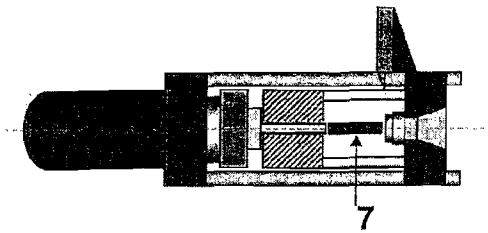
FIG. 1.3
(Prior Art)
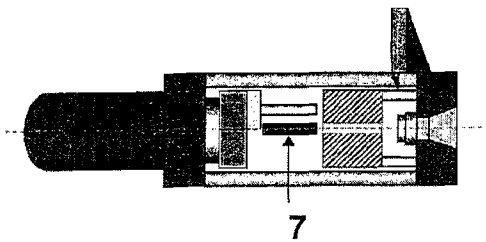
FIG. 1.2
(Prior Art)

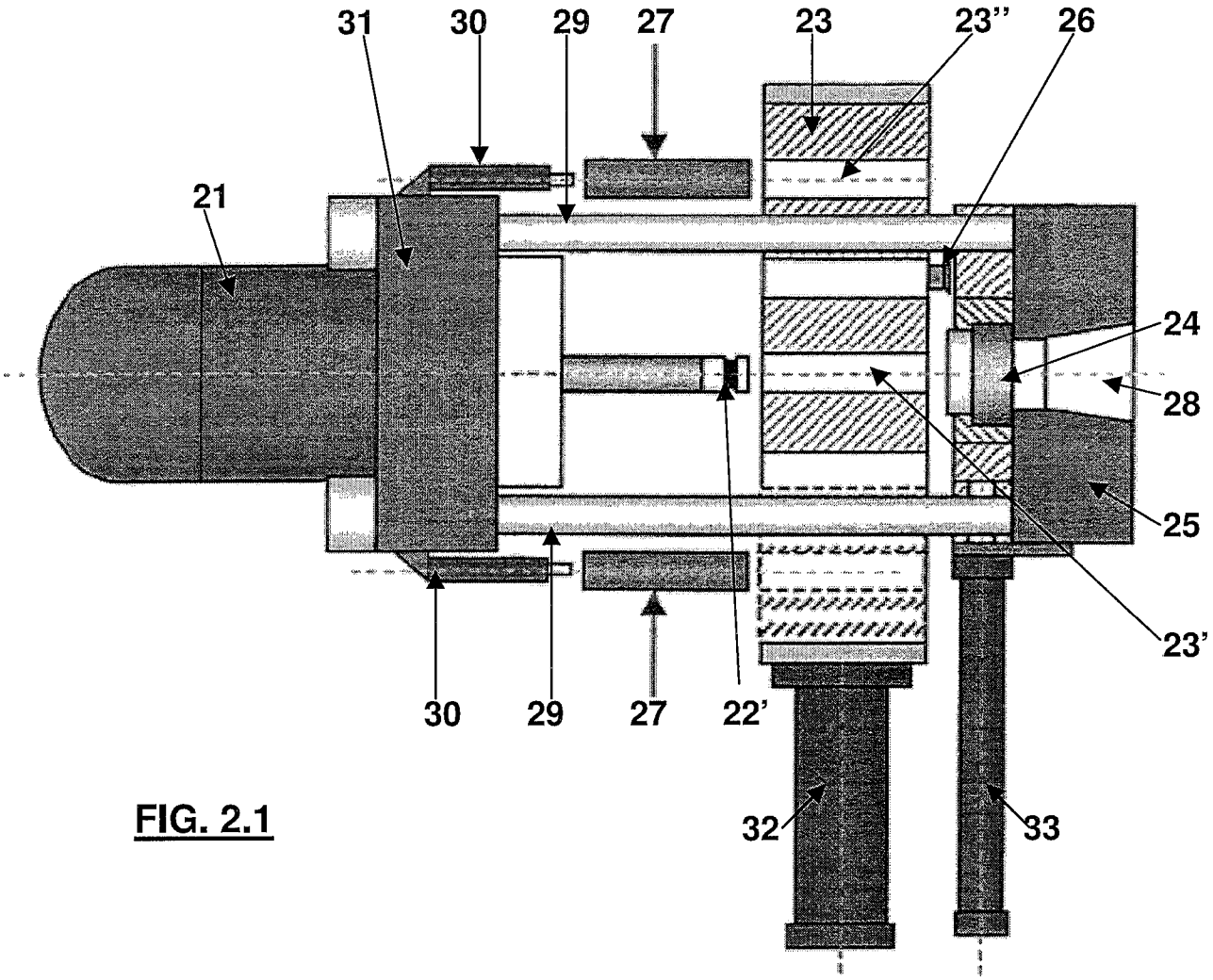
FIG. 2.1

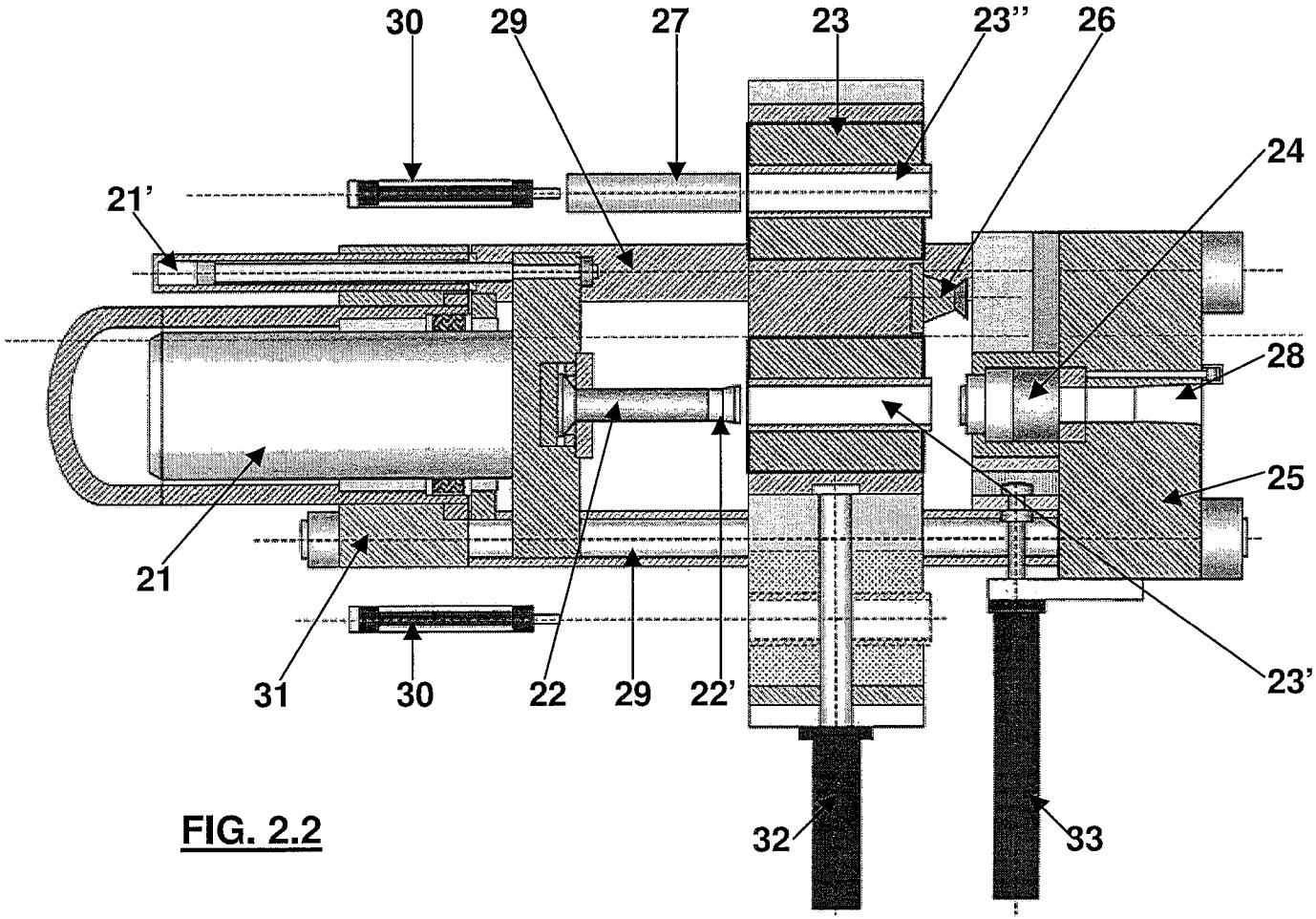
FIG. 2.2

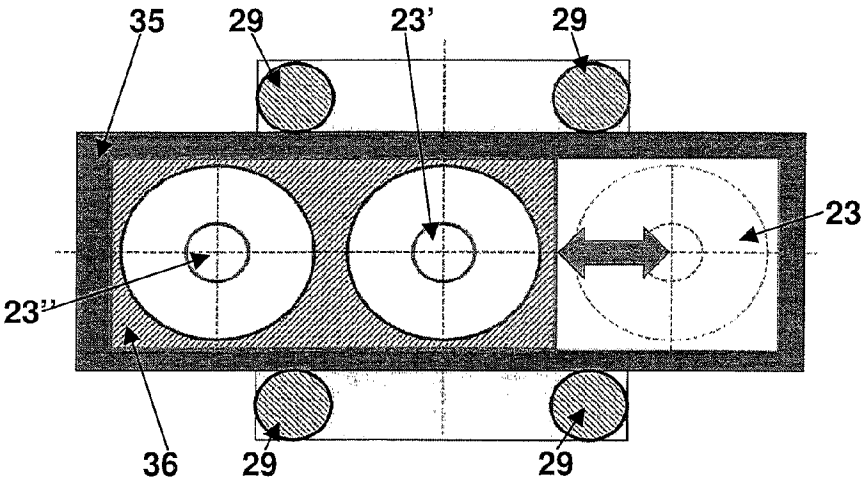
FIG. 3.1
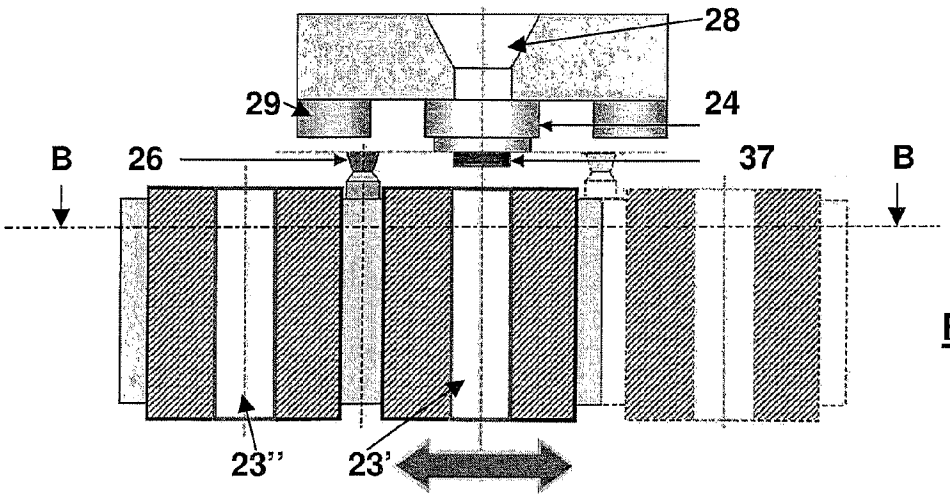
FIG. 3.2

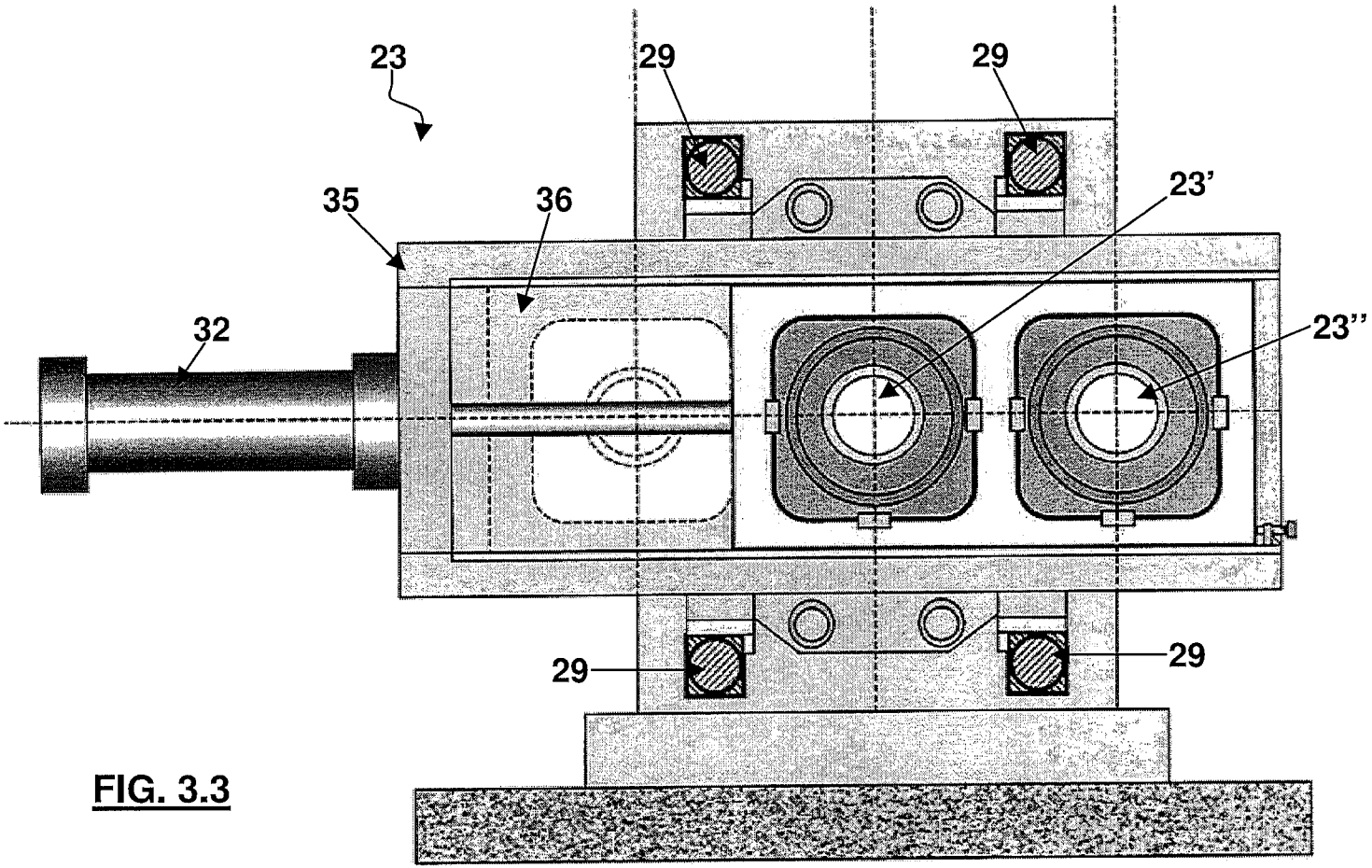
FIG. 3.3

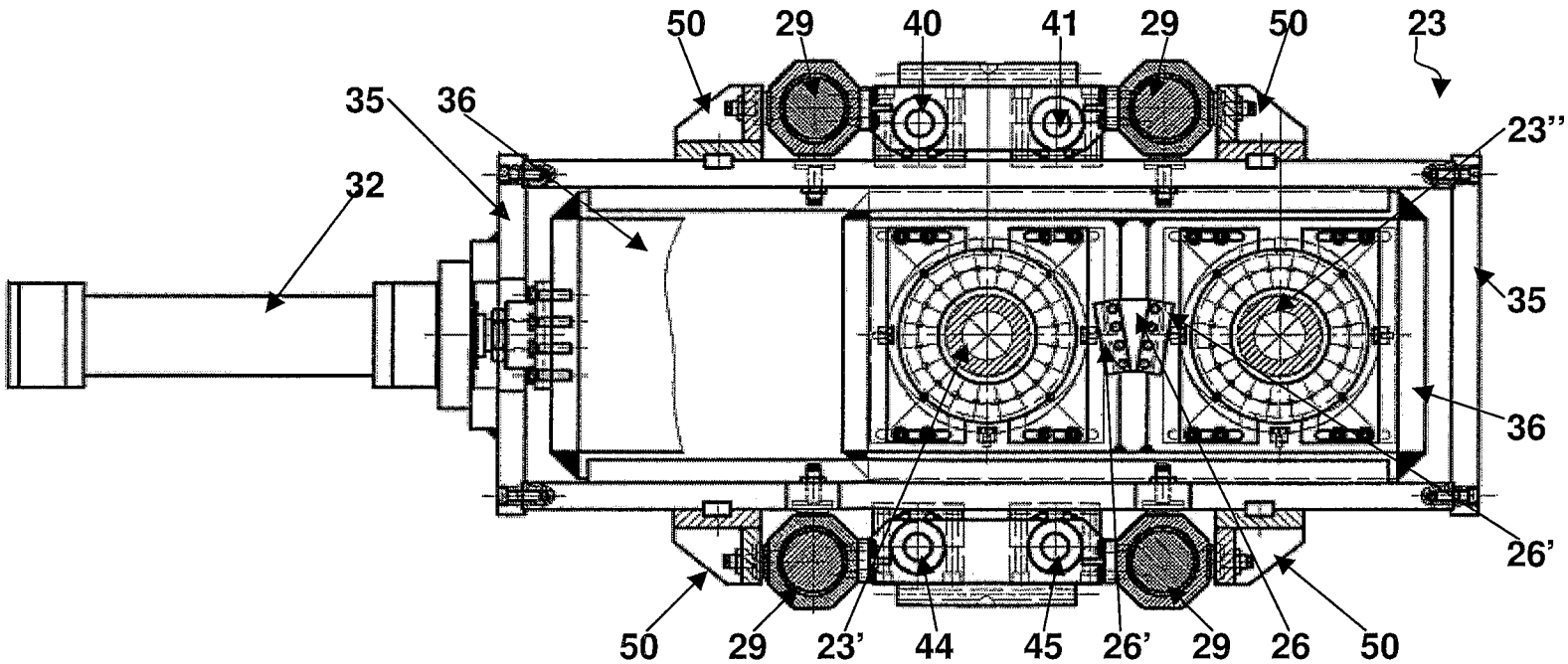
FIG. 3.4

FIG. 5.1
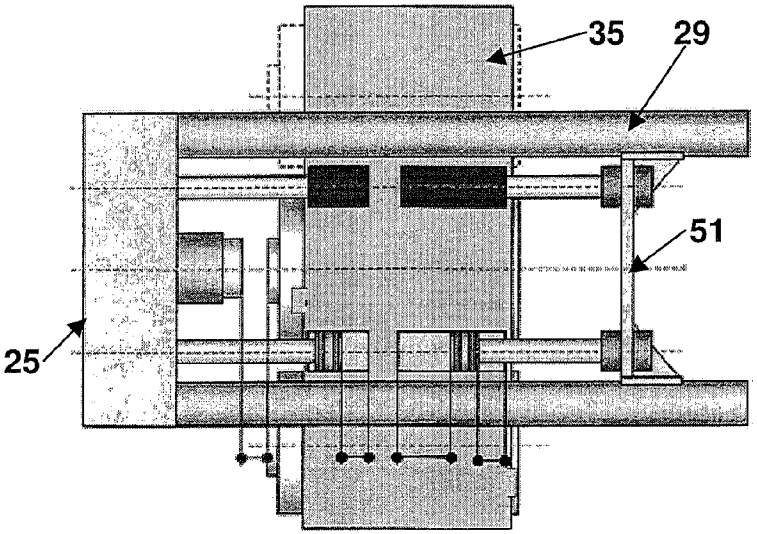
FIG. 5.2
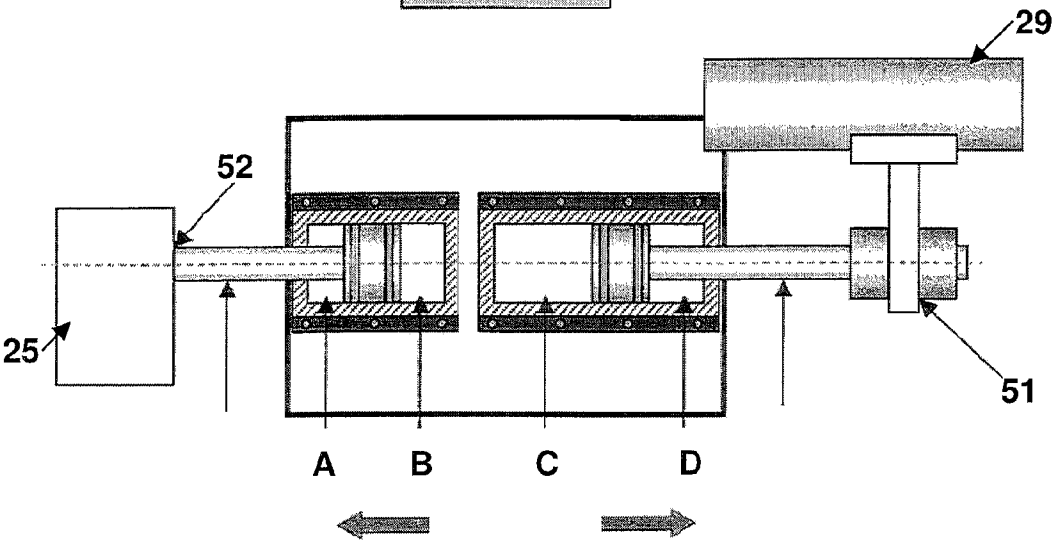

FIG. 6.1
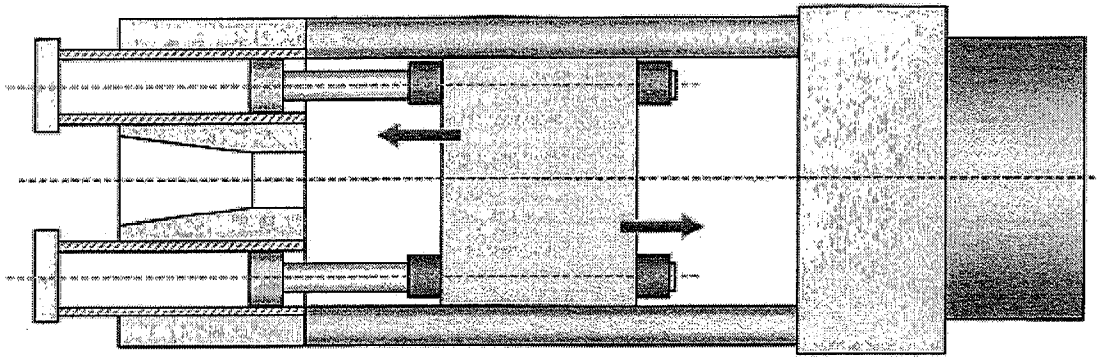
FIG. 6.2
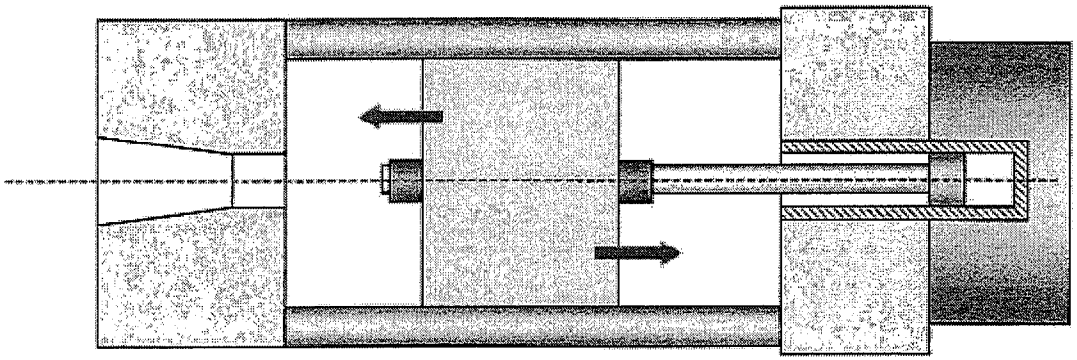

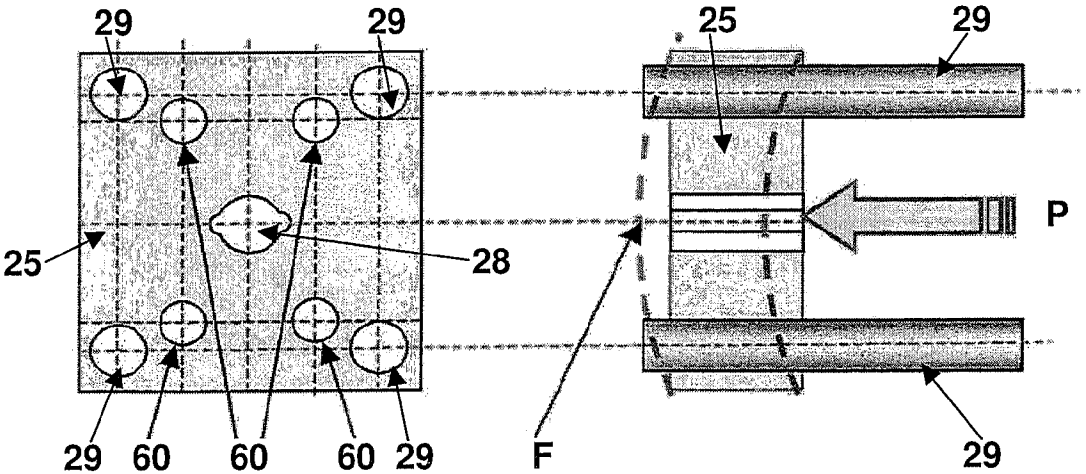
FIG. 7.1
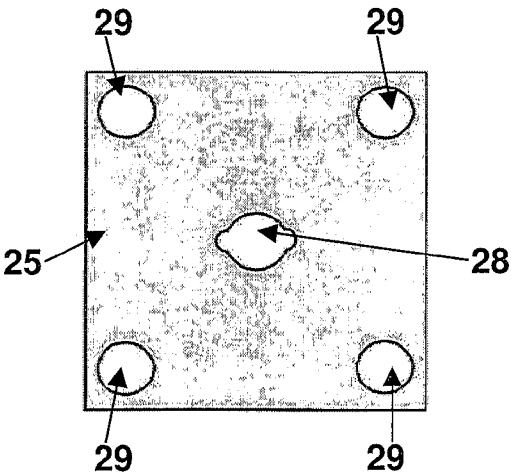
FIG. 7.2

MULTIFUNCTIONAL EXTRUDING PRESS WITH MULTIPLE EQUIPMENT AND EXTRUSION METHOD THEREOF

FIELD OF THE INVENTION

The present invention relates to a multifunctional extruding press with multiple equipment and to an extrusion method thereof.

STATE OF THE ART

With reference to FIG. 1.1, the extruding presses of known type essentially comprise the following components.

There is a main cylinder 1 with the task of providing the thrust or force for deforming a billet 7.

The billet 7 is the starting product for the extrusion process, and may be made of various metals or alloys (aluminum, copper, brass, steel, etc.) and may have various diameters.

The thrust of the main cylinder 1 is proportioned to the type of metal being machined (typically aluminum, copper, brass, steel) and to the diameter of the billet. The currently marketed presses develop extrusion forces from 1000 to 10000 tons (and more), while the diameters of the billets may be in the range from 127 mm (5") to 610 mm (24").

Each metal has a specific working pressure under which extrusion is impossible. For example, aluminum has a specific pressure=50/64 kg/mm$^2$ (billet area).

The extrusion speeds also differ according to the metal to be machined: e.g. aluminum 0/30 mm/sec, copper and brass 0/65 mm/sec, steel; 0/400 mm/sec.

A pressing shank 2, forming an extension of the main cylinder 1, has about the same diameter as the billet and serves the function of compressing the billet 7 within a hole 3' provided in the container 3 against a matrix 4. A pressing heel 2' dimensioned such to prevent leakage of metal is present at the end of the pressing shank.

Container 3 serves the function of containing the billet 7 within the hole 3' during the extrusion process, and directing the flow of metal into the matrix 4.

The container is kept heated at heating temperatures depending on the metal to be extruded, e.g. aluminum 410° C.

Matrix 4 is a mold with a machined hole having the shape of the product to be obtained. The metal (deformed by the thrust force of the main cylinder) flows therethrough thus taking the desired shape and forming bars even up to 50 meters long.

The bar will have the same weight as the billet introduced into the container and its length will depend on its section.

The die platen element 5 serves to contrast the force of the main cylinder 1. In the middle thereof there is provided a hole 8 allowing the section generated in the matrix 4 to come out. The head 5 is firmly connected to the cross element of the main cylinder 1 by means of longitudinal columns 9.

Container 3 retracts from the matrix 4 before the pressing heel touches the matrix when the billet 7 has been extruded. During this step, transversally moving shears 6 cut the last piece of billet (named "base") which remains attached to the is matrix itself in the space between the matrix and the container.

Extruding presses of known type are essentially of three types:

Long press (FIG. 1.1)

In this type of press, the billet is loaded with the main piston completely retracted and the container completely closed against the matrix. For this reason, the press must have three spaces, i.e. a space for the billet, a space for the container and a space for the pressing shank.

At the end of the extrusion, the main piston retracts and the container opens to make room for the shears for cutting the bases. After shearing, the container closes and only then can the next billet be loaded to start a new cycle.

Short press with movable shank (FIG. 1.2)

In this type of press, the billet is loaded with the container open, at the same time as shearing, and with the pressing shank moved to the side. For this reason, the press needs two spaces, i.e. one space for the billet over the shank and one space for the container.

Short press with front billet loading (FIG. 1.3)

In this type of press, the billet is loaded between the container and the matrix. In order to obtain the required space, the opening stroke of the container is longer than the maximum length of the billet. The pressing shank remains inside the container during the step of loading. In order to extract the billet loader, before closing the container, the billet is supported by the pressing shank which pushes it against the matrix (this is a very delicate operation). This type of press also needs two spaces, i.e. one space for the billet and one space for the container over the shank.

These types of known presses have major problems related to excessively long dead times needed to replace the billets to be extruded and shear the bases: each billet replacement may require a time ranging from 15 to 30 seconds, and there is no active working during this time. Considering that these presses work in a continuous cycle, the dead times negatively and severely affect the machine productivity.

A further important problem is related to the movement system of the shears which is complicated and large in size. Indeed, the shears of known type (6, FIG. 1.1) have a vertical arrangement and are supported by a large structure, firmly fastened to the die platen element. The movement is impressed thereon by a cylinder which works by means of the main pumps which impress their force on a blade-holder ram or slide. The blade slides on two long guides which prevent its slipping when shearing; an appropriate screw adjustment system allows to align the guides and take up clearance.

SUMMARY OF THE INVENTION

It is thus the object of the present invention to disclose a multifunctional extruding press with multiple equipment apt to overcome all the aforesaid drawbacks.

The object of the present invention is an extruding press comprising: a die platen element with at least an extrusion matrix thereon, from which an extruded product comes out; a main cylinder with a relative pressing shank for billets made of manufacturing material; longitudinal columns connecting said head to said main cylinder; a multiple equipment assembly provided with at least two longitudinal containers for housing said billets, and comprising an external, longitudinally moving cross element and an internal ram inside said cross element, said internal ram being transversally movable and comprising said at least two containers; means for longitudinally moving said equipment assembly, apt to tightly close one of said containers with said extrusion matrix; means for transversally moving said internal ram, apt to make one of said containers face said matrix for extruding said billet, and also apt to make one or more of said other containers face means for introducing the billets at the same time as said extrusion of the billet.

It is a further object of the present invention a process for extruding billets by means of a press as described above, comprising the steps of:

transversally moving said internal ram of the multiple equipment assembly, for advancing a billet towards said manufacturing matrix, and simultaneously loading one or more other billets in other containers of said multiple equipment assembly;

longitudinally moving said multiple equipment assembly, being advanced for tightly holding said container during extrusion against said matrix and retracted for allowing said transversal moving.

It is a particular object of the present invention an extruding press with multiple equipment assembly, and an extruding process as described in greater detail in the claims which form an integral part of the present description.

BRIEF DESCRIPTION OF THE DRAWINGS

Further objects and advantages of the present invention will be apparent from the following detailed description of an embodiment thereof (and variants thereof) and from the accompanying drawings given by the way of mere non-limitative example, in which:

FIGS. 1.1, 1.2, 1.3 diagrammatically show extruding presses of known type;

FIGS. 2.1, 2.2 show an extruding press in accordance with the invention, at diagrammatic level and in longitudinal section respectively;

FIGS. 3.1, 3.2, 3.3, 3.4 show the transversal moving system of the multiple equipment assembly of the press according to the invention, taken along section B-B, in a diagrammatic top view, in a diagrammatic front view and in a detailed front view, respectively;

FIGS. 5.1, 5.2 show details of the cylinders of the longitudinal moving system, in a top view and in a detail thereof, respectively;

FIGS. 6.1, 6.2 show assembly details of the cylinders of the longitudinal moving system for two types of known presses;

FIGS. 7.1, 7.2 show details of the die platen element of a press of known type and according to the invention, respectively.

The same reference numbers and letters in the figures refer to the same elements or components.

DETAILED DESCRIPTION OF A PREFERRED EMBODIMENT OF THE INVENTION

Figure 4:
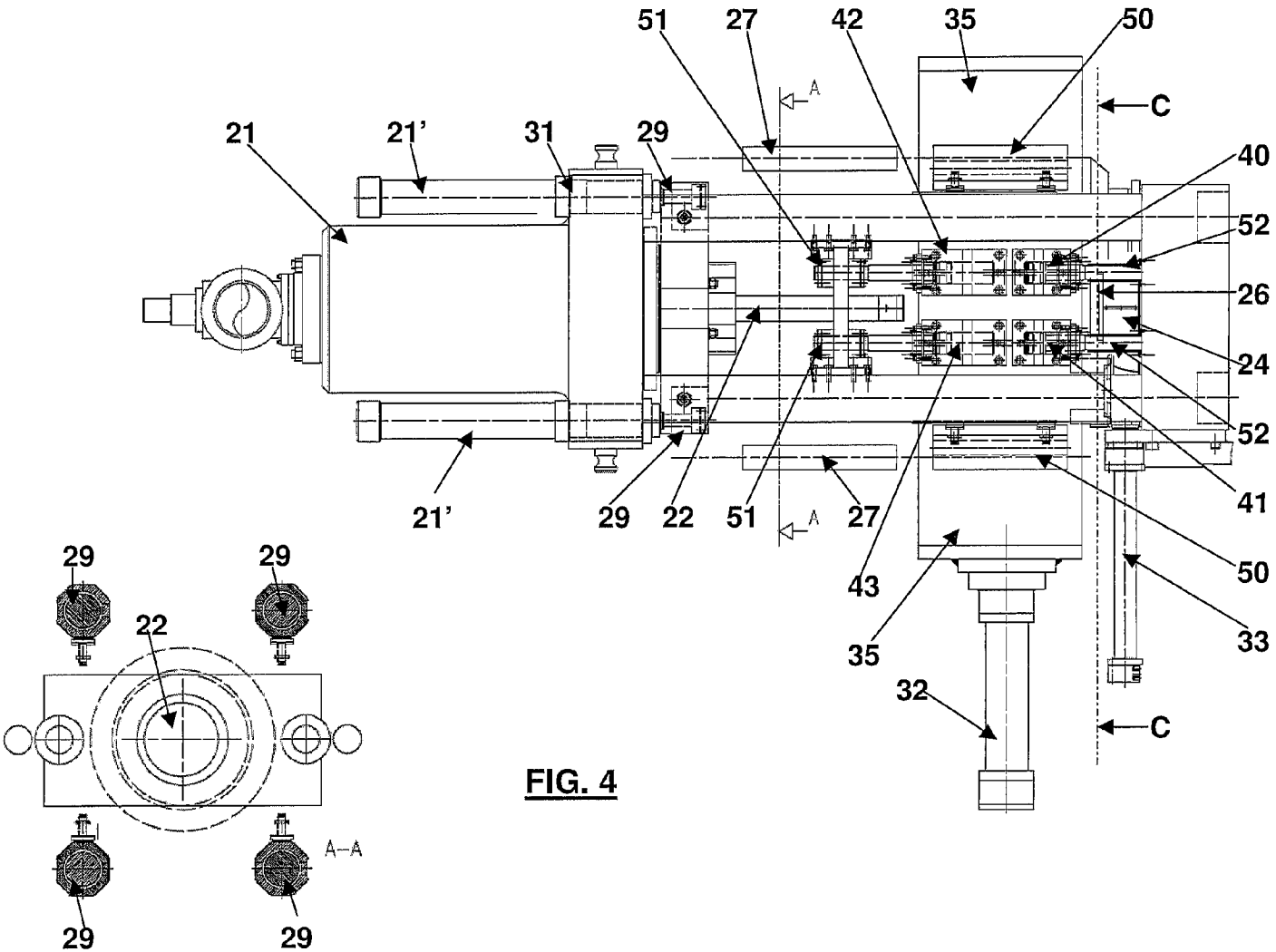
FIG. 4 shows a top view of the longitudinal moving system of the multiple equipment assembly of the press according to the invention.

The multifunctional extruding press with multiple equipment object of the invention will now be described with reference to the accompanying figures.

With particular reference to FIGS. 2.1, 2.2, numeral 21 indicates a main cylinder of per se known type.

Numeral 22 indicates a pressing shank with corresponding pressing heel 22' of per se known type.

Numeral 25 indicates a die platen element in which there is provided a hole 28 known per se, in which the matrix 24 is present on the inner side thereof. The matrix may be laterally moved by means of an appropriate cylinder 33.

In accordance with the invention, a multiple equipment assembly 23 is provided, consisting of a cross element 35 and a ram or slide 36 equipped with a plurality of containers for accommodating the billets 27. Two containers 23', 23" are shown in the figures, but this is not to be intended as a limitation because more than two containers are also possible. The containers may be moved transversally with respect to the extruding axis by means of an appropriate cylinder 32.

With particular reference to figures from 3.1 to 3.4, a transversal movement with respect to the extruding axis is made during each machining cycle, such that one of the containers (e.g. 23' in the figures) faces the matrix 24 for extruding the billet therein, while another container (e.g. 23" in the figures) is in a side position for loading a new billet 27 by means of an appropriate cylinder 30, or other suitable loading device, which pushes it into the hole. The loading of the new billet is thus simultaneous with the extrusion of the previous billet.

Appropriate shears 26 are positioned in front of the ram, which shears substantially comprise two blades 26' (FIG. 3.4) which, during the transversal movement of the ram, touch the face of the matrix 24, cutting off the base 37 remained thereon upon the newly finished billed extrusion. Before the transversal movement, the cross element 35 and ram 36 are retracted so as to allow the blade 26 to rub on the matrix 24.

More in detail (FIG. 3.3, 3.4), in one embodiment, the multiple equipment assembly has an external cross element 35 which contains an inner ram 36, transversally mobile by controlling the cylinder 32, which includes the containers 23', 23" into which the billets are inserted. The containers may be extracted and replaced in order to be able to use billets of different diameter.

The shears 26 with the two blades are fixed at the front between the containers. The two blades 26' are suitably inclined with respect to the transversal movement to reduce the cutting impact and favor the base falling.

With reference to FIGS. 3.4 and 4, the control cylinders (40, 41, 42, 43, 44, 45, 46, 47) controlling the longitudinal movement of the multiple equipment assembly are fixed on the external cross element 35, two pairs of cylinders facing one another and being opposite on the two opposite sides of the cross element 35. In particular, FIG. 4 shows four cylinders (40, 41, 42, 43) present on the upper side of the equipment assembly. An equal number of cylinders is present on the lower side. Cylinders 44, 45 are shown in FIG. 3.4. Cylinders 46, 47 are not shown in the figures.

Suitable slides 50 are fixed to the columns 29 for guiding the longitudinal movement of the multiple equipment assembly.

The shanks 52 of cylinders 40, 41, 44, 45 abut on the die platen element 25, while the shanks of cylinders 42, 43, 46, 47 are fixed to the columns 29 by means of fastening elements 51.

The chambers in which the cylinder pistons slide are instead double and closed, and are fixed to the external cross element 35. The cylinders with the shank facing the die platen element 25 have two chambers indicated by letters A and B, while those facing the main cylinder 21 have two chambers indicated by letters C and D. Said chambers are appropriately pressurized to determine the forward and backward movement of the multiple container system 35, 36.

More in particular, the longitudinal movement cycle of the container is controlled by the cylinders as follows.

After extruding a billet, chambers B+D work to obtain an opening movement with pull backward movement, at end of which (normally 30/40 mm) the retraction stroke proceeds with chamber B.

During the transversal movement of the ram and consequent shearing, chambers B and C are kept pressurized (e.g. at 30/40 bars); thereby the ram will not be able to move and an accurate shearing will be obtained.

Chamber D is pressurized after totally opening.

Chamber C is pressurized when the multiple equipment assembly is closed upon sealing the container against the matrix.

Chamber C is pressurized during the active working cycle.

In extruding presses of known type, the control cylinder housings may be made either on the die platen element (FIG. 6.1) or on the main cylinder cross element (FIG. 6.2).

Instead, in accordance with the invention, the following important advantages are obtained by fixing the cylinders to the cross element 35 of the equipment assembly.

Resistance to fatigue of the die platen element is improved and not less importantly, expensive mechanical machining processes for making the cylinder housing holes inside the structural elements of the press are eliminated.

The main function of the die platen element 25, or simply die platen, is to contrast the force impressed by the main cylinder 21, thus making the press an hyperstatic system.

Despite the hyperstaticity of the system, the die platen element undergoes a flexion F (FIG. 7.1) caused by the pressure P on the billet, and thus on the matrix which may even be of the order of thousands of tons. Typical flexion values may be 0.6/1.2 mm in the middle of the die platen element. The flexion of the die platen element negatively affects the extrusion position accuracy because the matrix 24 also bends, thus negatively affecting the extruded section thickness.

In presses of known type, the presence of the holes 60 (FIG. 7.1) in which the control cylinders are accommodated weakens the die platen element, making it more subject to flexion, while said holes are no longer present in the die platen element according to the invention (FIG. 7.2), thus making it more robust and less subject to flexion.

The following may be said with regards to the machining cycle time of the press object of the invention.

No time is wasted for loading the billet because this occurs during the extrusion cycle, thus the time is overlapped and equal to zero seconds.

At the end of extrusion, the main piston starts the return stroke and the equipment assembly opens by about 100 millimeters. Typical return speed values of the main piston are 500 mm/sec, while the opening speed of the equipment assembly may be 60 mm/sec.

When the cross element reaches the set opening position, the transversal ram stroke starts, whereby the container which was outside takes the position in front of the matrix with the billet already loaded.

The base blade, which during the transversal movement of the ram shears the base attached to the matrix, is mounted on the front side towards the matrix interposed between the two containers. Therefore, the shearing time may be considered as an overlapping time coinciding with another operation, thus equal to zero seconds.

At the end of the side translation, the multiple container system may advance towards the matrix (typical stroke value 100 mm) while the main piston may advance thus starting a new extrusion cycle.

Given the premises above, the total dead time DT of each extrusion process may be as follows.

Starting from the end of an active extrusion operation:

Piston return=X seconds

Container opening (overlapping time=0)

Transversal movement of containers=Y seconds

Shearing (overlapping time=0)

Main piston advancement=Z seconds

Container closing (overlapping time=0)

Billet loading (overlapping time=0)

Therefore, DM=X+Y+Z, which as shown by the numeric example below is much less than the known systems.

The function of the side cylinders 21' is to move the main cylinder 21 forwards and backwards. Indeed, as the main cylinder is of plunging type, and thus single-acting, it must be moved by other cylinders for the return movement.

In the forward movement, the side cylinders are used to push the main cylinder at high speed (about 500 mm/sec) in idle movements, when no force is needed. The side cylinders add their force to the main cylinder during the step of extruding.

In the backward movement, the side cylinder pulls back the main cylinder at the end of extrusion during the dead time.

Considering a specific example, 2500 ton extruding press may produce 1800/2000 kg/h of net extrudate. Considering an average weight of 80 kg per billet, it results:

2000:80=25 billets/h; 25×5520 h=138000 billets/h.

As a dead time corresponds to each billet loaded in the press, the dead times are repeated 138,000 times a year.

Assuming that the press having the mobile shank of known type has an average dead time of 20 sec, the yearly dead time will be:

20 sec×138000 billets/year=2760000 sec, thus 766 h.

The dead time DM of the press object of the invention is assumed to be of about 10 sec, therefore:

10 sec×138000 billets/year=1380000 sec, thus 383 h/year.

As compared to the above-discussed press of known type, 383 h are saved, which are hours of actual production.

According to the example above, in 383 h 383 h×2000 kg/h=766000 kg of extrudate more may be produced.

Other possible design variants of the described non-limitative example are possible, without therefore departing from the scope of protection of the present invention, thus comprising all the equivalent implementations for a person skilled in the art.

The advantages deriving from the application of the present invention are apparent.

In particular, the machining dead times are reduced with consequent increase of production time and simplification of the extrusion process, and the manufacturing complexity of the press is reduced.

A further important advantage is the energy saving allowed by the possibility of a smaller dimensioning of the power both installed and consumed by the press. Indeed, the working speed of the extrusion presses depends on the type of metal to be extruded and is mainly determined by two factors: the installed maximum hydraulic capacity and the diameter of the moving control cylinders. This also affects the dimensioning of the hydraulic pumps.

In presses of known type, the hydraulic capacity is very high because the idle strokes of the cylinders (during the machining dead times) are long and carried out at high speed in order to decrease machining dead times, with the consequent need for large dimensioning of the electric motors of the pumps according to their maximum pressure. Therefore, the installed and consumed power needs to be high.

In the extruding press object of the present invention, instead, the moving cylinders strokes are short and the chamber diameters are small; indeed, the machining dead times are greatly reduced and high capacities are not required. Therefore, a lower dimensioning of the power both installed and consumed by the press is obtained.

More in particular, the installed power has been reduced as compared to a currently marketed press by about 50%.

Furthermore, the electric panel for each installed electric motor is provided with electronic devices for monitoring the electricity consumption which allow to save from 10% to 25%, by acting, according to the load, on the power supply voltage and thus reducing the losses in coils and increasing the efficiency of the electric motors.

From the description above, a person skilled in the art will be able to implement the object of the invention without introducing further constructional details.

The invention claimed is:

1. Extruding press comprising:

a die platen element with at least one extrusion matrix for producing an extruded product along a longitudinal direction;

a main cylinder with a relative pressing shank for billets made of manufacturing material;

longitudinal columns connecting said die platen element to said main cylinder;

a multiple equipment assembly provided with at least two longitudinal containers for housing said billets, and comprising an external, longitudinally moving, cross element and an internal ram inside said external cross element, said internal ram being transversally movable with respect to said longitudinal direction and comprising said at least two longitudinal containers;

means for longitudinally moving said multiple equipment assembly, adapted to tightly close a first longitudinal container of said at least two longitudinal containers with said extrusion matrix;

means for transversally moving said internal ram, adapted to make said first longitudinal container face said extrusion matrix for an extrusion of a first billet, and also adapted to make at least one second longitudinal container of said at least two longitudinal containers face means for a loading of a second billet simultaneously with the extrusion of the first billet;

wherein said means for longitudinally moving said multiple equipment assembly comprise pairs of control cylinders facing and being opposite one another, said pairs of control cylinders being placed on two opposite external sides of the external cross element, wherein said control cylinders are provided with double and closed chambers for respective pistons, said chambers being externally fastened on said external cross element, and are provided with respective shanks, wherein first control cylinders of said pairs of control cylinders, having a first shank facing the die platen element, have said first shank abutting on said die platen element, while second control cylinders of said pairs of control cylinders, opposed to said first control cylinders and having a second shank facing the main cylinder, have said second shank fastened on said longitudinal columns.

2. Extruding press according to claim 1, further comprising a blade shears such that in the transversal motion of the multiple equipment assembly said blade shears come into contact with said extrusion matrix for removing a manufacturing base of the first billet.

3. Extrusion press according to claim 2, wherein said blade shears comprise two blades, frontally fastened towards said extrusion matrix, said two blades being inclined with respect to the transversal motion in order to diminish a cutting impact and to favor a removal of the base.

4. Process for the extrusion of billets by means of a press according to claim 1, comprising the following steps:

transversally moving said internal ram of the multiple equipment assembly, for advancing a first billet towards said extrusion matrix, and simultaneously loading one or more second billets in at least one second longitudinal container of said multiple equipment assembly;

longitudinally moving said multiple equipment assembly, being advanced for tightly holding said first longitudinal container against said extrusion matrix and retracted for allowing said transversal moving.

5. Process for the extrusion of billets according to claim 4, wherein said step of transversally moving comprises a cut of a billet base by means of blades, contacting said extrusion matrix.

6. Process for the extrusion of billets according to claim 5, wherein said step of longitudinally moving comprises the operation of control cylinders of said longitudinally moving means putting under pressure cylinder sliding chambers.

* * * * *